United States Patent [19]

Szabo

[11] 4,189,037

[45] Feb. 19, 1980

[54] MOUNTINGS FOR DUPLEX HANDLES FOR ATTACHÉ CASES AND THE LIKE

[75] Inventor: Bela G. Szabo, Carnegie, Pa.

[73] Assignee: Bruce Plastics, Inc., Pittsburgh, Pa.

[21] Appl. No.: 19,879

[22] Filed: Mar. 12, 1979

[51] Int. Cl.[2] ..... A45C 13/26

[52] U.S. Cl. ..... 190/58 R; 16/126

[58] Field of Search ..... 190/58 R, 58 A, 58 B, 190/58 C, 57; 220/94 R; 16/126

[56] References Cited

U.S. PATENT DOCUMENTS

| | | | |
|---|---|---|---|
| 2,311,664 | 2/1943 | Johnson | 190/57 X |
| 3,107,761 | 10/1963 | Storey | 190/58 R |

*Primary Examiner*—Donald F. Norton

*Attorney, Agent, or Firm*—Samuel Lebowitz

[57] ABSTRACT

Mountings for duplex U-shaped handles for luggage items of relatively small depth, for example, attaché cases, in which the pair of spaced pintles for rotatably supporting each handle on each of the casing halves, is positioned close to the parting line between the open halves of the luggage case. Thereby, each handle in its inoperative position adjacent to the top of the case, does not extend beyond the outer wall thereof. To attain this objective, the opposed arms of each U-shaped bar extending upwardly from its fastening base-plate for supporting the opposite ends of each pintle, is curved inwardly towards the parting line, with the apertures at the ends thereof for each pintle disposed coaxially in each coplanar terminal portion of each arm.

2 Claims, 8 Drawing Figures

Fig. 1
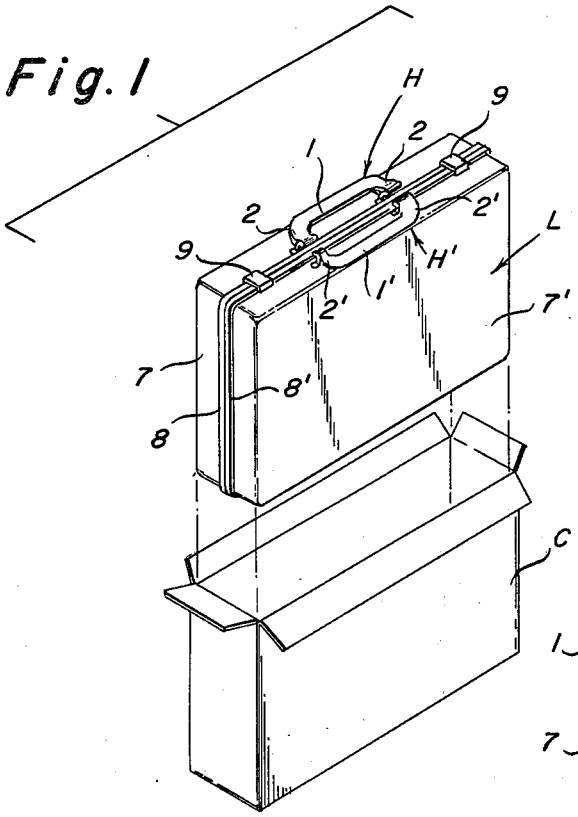
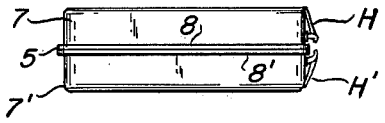
Fig. 2
Fig. 3
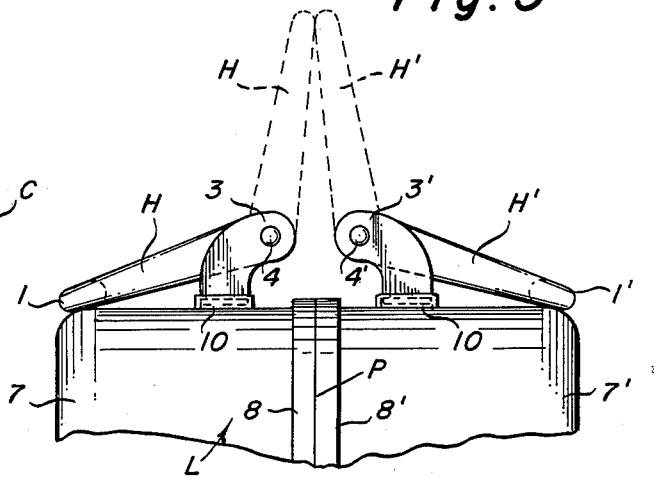
Fig. 4
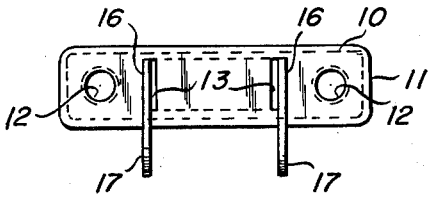
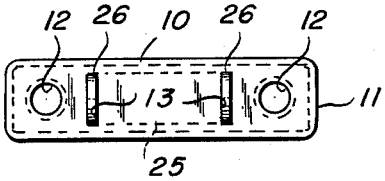
Fig. 7
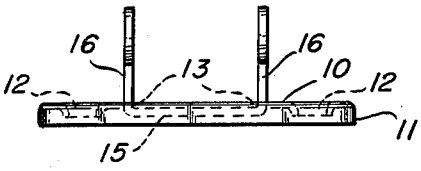
Fig. 5
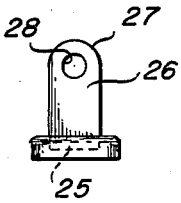
Fig. 8
PRIOR ART
Fig. 6
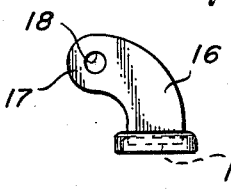

MOUNTINGS FOR DUPLEX HANDLES FOR ATTACHE CASES AND THE LIKE

This invention relates to mountings for carrying handles for attaché cases and similar luggage items which are of relatively small depth.

It is the object of the present invention to provide mountings for duplex luggage handles each of which is pivotally mounted to each of a pair of casings of relatively small depth, so that the handles may assume a comfortable operative position for carrying, and at the same time be capable of assuming an inoperative position on the top of the luggage casings without projecting beyond the outer boundaries of the latter, so that packaging and storing of the luggage items may be effected conveniently and economically without impediment by the handles protruding beyond these boundaries.

It is another object of the present invention to modify the straight U-Bar arrangement for supporting the pintles for luggage handles in a manner to dispose the latter closer to the parting line of the luggage casings in order to enable the luggage handles to assume positions on the top of the casing without projecting beyond the outer boundaries of the latter. Thereby the cartons for packaging the luggage items may conform to the dimensions of the latter without waste of shipping space. Furthermore, the confinement of the handles within the boundaries of the luggage unit minimizes the possibilities of harm and damage thereto in the course of handling during use and transport thereof.

It is a further object of the invention to provide an economical handle mount construction which may be used interchangeably with other handle mounting assemblies which result in economies in manufacture and inventory maintenance.

Other objects and purposes will appear from the detailed description of the invention following hereinafter, taken in conjunction with the accompanying drawings, wherein FIG. 1 is a perspective view of the luggage case in accordance with the invention preparatory to its insertion in a packing carton therefor;

FIG. 2 is an end elevation of the luggage unit in horizontal position;

FIG. 3 is an enlarged end view of the luggage item shown in FIG. 1 with the handles, in inoperative position, shown in solid lines, and with the handles, in operative position, indicated in dotted lines;

FIG. 4 is a plan view of the mounting assembly in accordance with the invention;

FIG. 5 is a front elevation of FIG. 4;

FIG. 6 is a right end view of FIG. 5;

FIGS. 7 and 8 are plan and end views, respectively, of a straight U-Bar assembly as presently used and over which the curved U-bar of the instant invention is an improvement.

Many arrangements for mounting U-shaped carrying handles on luggage have been devised in the past, and the construction in U.S. Pat. No. 3,107,761, Oct. 22, 1963, is illustrative of such. The use of mounting assemblies with apertured straight U-bars for receiving the ends of the pintles for pivotally supporting the handles, presents a simplification of the construction disclosed in this patent. However, special problems are presented in the mounting of handles on luggage items of relatively small depth, such as attaché cases, in which case U-shaped handles of sufficient depth to afford comfort in carrying are so high, that when they are dropped to an inoperative position on the top of the luggage item, the hand-grip portions of the handles project beyond the outer lateral boundaries of the attaché case, so that special problems occur when the latter is packed for shipping, as shown in FIG. 1 of the drawings, or the case is disposed on a flat surface, such as a table, as illustrated in FIG. 2.

The mountings of the instant invention are so designed as to dispose the pivotal axes of the handles closer to the parting line of the case, so that the handles may be disposed in their alternate positions, as indicated in FIG. 3, to afford maximum comfort while carrying the luggage case, and assuring that the handles, in their inoperative positions are within the confines of the top of the luggage case. This desideratum has been attained in other receptacles such as tool boxes, as illustrated in U.S. Pat. No. 2,311,664, Feb. 23, 1943, but by entirely different means.

As shown in the drawings, the luggage item L is formed of symmetrically disposed open casings 7,7' which may be provided with marginal parting strips 8 and 8', respectively, suitably joined on the bottom of the luggage case by hinge means 5, and which may be secured by suitable locking means 9 at the top of the case.

The duplex handle is formed of allochiral U-shaped parts H, H' provided with hand-grips 1, 1', respectively, from the opposite ends of which project legs 2, 2', the free ends of which are suitably apertured, to engage pintles 4 mounted at longitudinally displaced points on the top of the midportion of each casing.

The mountings in accordance with the invention for the pintles 4, are shown in FIGS. 4, 5 and 6, each comprising a base plate 10 having a perimetral flange 11 which is pressed into close contact with the exterior of the luggage case by the penetration of suitable fastening means such as rivets, bolts, screws and the like, through openings 12 adjacent to the opposite ends of the base plate. A pair of transverse slots 13 are stamped in the base plate, through which extends a U-shaped sheet metal bar formed of a cross bar 15 of a length corresponding to the displacement between the transverse slots and upwardly extending arms 16 bent perpendicularly from the cross bar for passage through the slots. The terminal portions of the arms 17 are coplanar with the arms 16 and curve laterally therefrom to dispose the ends of the arms above the parting line P between the casings and closely adjacent to the plane thereof. The free ends of the arms are provided with apertures 18 for the mounting of the coaxial pintles 4 which extend between the arms and which pivotally support the apertured ends of the handles H and H'.

As may be readily seen from FIG. 3, the pivotal axes of the handles, by their disposition close to the plane of the parting line, present the handles in close juxtaposition, as indicated in dotted lines, for comfort in carrying. At the same time, in their inoperative position, the handles rest upon the top of the luggage case without protruding beyond the outer lateral walls of the cases 7 and 7', so that the latter may be dropped conveniently into storage or shipping cartons, or supported on flat surfaces without interference from the handles. Since the handles do not protrude beyond the outer walls of the case, rough handling of the luggage at airports and other points of luggage transfer, does not result in damage thereto.

The base plates 10 of the invention may be used interchangeably with straight U-bars as shown in FIGS. 7 and 8, wherever this is desired. As shown, the cross bar 25 is disposed adjacent to the underside of the mounting plate 10 with the arms 26 extending through the apertures 13 in a vertical direction. The mounting of the pintles within apertures 28 at the ends of the arms 27 result in the pivotal mounting of the handles at a distance from the parting line of the luggage case so that the resultant divergent angle between the handles results in both discomfort during the carrying of the luggage case, as well as problems in the shipping and storage thereof in consequence of the protrusion of the handles of the hand-grip beyond the lateral walls of the casings.

While the base plates 10 in the illustrated embodiment of the invention have been shown as rectangular in contour, these may be oval-shaped or of any other contour, if desired.

I claim:

1. In a duplex handle assembly for a luggage-case formed of a pair of symmetrically arranged relatively thin open casings adapted to have the hand-grip at the top thereof above the parting line between the juxtaposed open surfaces of said casings remote from the hinged joint therebetween at the bottom of the luggage case, (a) a pair of mountings for a pair of coaxial pintles at longitudinally displaced points on the top of the mid-portion of each casing for pivotally supporting a U-shaped handle comprising lateral legs projecting from the opposite ends of a hand-grip with the free ends thereof having coaxial apertures for engaging said coaxial pintles on each casing, (b) each of said mountings comprising a base-plate with a pair of spaced narrow transverse slots at the midportion thereof, (c) a detachable U-shaped sheet metal bar having a pair of arms extending normally and upwardly from a crossbar with said crossbar fitting adjacent to the underside of said base plate and with said arms extending upwardly through said narrow slots, and (d) coplanar curved terminal portions on each of said arms extending above and beyond the inner edge of said base-plate and terminating above said parting line and adjacent to the plane thereof, and provided with apertures for receiving the ends of the respective pintle, (e) the close juxtaposition of the aligned pairs of pintles in close proximity to the parting line of the luggage case permitting the alternative close juxtaposition of the two handles in substantially vertical position to provide a comfortable hand-grip for carrying, and the disposition of the handles in substantially horizontal resting position on top of and within the boundaries of said casings to permit convenient storage and packaging.

2. A device as set forth in claim 1, wherein each base-plate is provided with openings adjacent to the opposite ends thereof for the passage of fastening means for affixing said base-plates to said casings.

* * * * *